US006516551B2

(12) United States Patent
Gaber

(10) Patent No.: US 6,516,551 B2
(45) Date of Patent: Feb. 11, 2003

(54) OPTICAL SIGHT WITH SWITCHABLE RETICLE

(75) Inventor: Leonid Gaber, South San Francisco, CA (US)

(73) Assignee: American Technologies Network Corporation

( * ) Notice: Subject to any disclaimer, the term of this patent is extended or adjusted under 35 U.S.C. 154(b) by 0 days.

(21) Appl. No.: 09/749,981

(22) Filed: Dec. 27, 2000

(65) Prior Publication Data

US 2002/0078618 A1 Jun. 27, 2002

(51) Int. Cl.[7] ..... F41G 1/34

(52) U.S. Cl. ..... 42/132; 42/123; 42/131; 42/130; 356/251; 356/256

(58) Field of Search ..... 42/123, 131, 132, 42/130; 356/251, 256

(56) References Cited

U.S. PATENT DOCUMENTS

| | | | | |
|---|---|---|---|---|
| 3,672,782 | A | * | 6/1972 | Akin et al. |
| 4,136,963 | A | * | 1/1979 | Budden et al. |
| 4,390,276 | A | * | 6/1983 | Budden et al. |
| 4,497,015 | A | * | 1/1985 | Konno et al. |
| 4,554,744 | A | | 11/1985 | Huckenbeck ..... 33/241 |
| 4,618,221 | A | | 10/1986 | Thomas ..... 350/566 |
| 4,695,161 | A | * | 9/1987 | Reed |
| 4,764,011 | A | * | 8/1988 | Goldstein |
| 4,863,269 | A | * | 9/1989 | Ellis |
| 4,904,895 | A | * | 2/1990 | Tsukamato et al. |
| 4,945,646 | A | * | 8/1990 | Ekstrand |
| 5,283,427 | A | * | 2/1994 | Phillips et al. |
| 5,901,452 | A | * | 5/1999 | Clarkson |
| 6,032,374 | A | * | 3/2000 | Sammut |
| 6,118,588 | A | * | 9/2000 | Yamamoto |
| 6,357,158 | B1 | * | 3/2002 | Smith, III |
| 6,453,595 | B1 | * | 9/2002 | Sammut |

FOREIGN PATENT DOCUMENTS

| | | | |
|---|---|---|---|
| WO | WO 79/00419 | * | 1/1997 |
| WO | WO 00/50836 | | 6/2000 |
| WO | WO 00/50836 | * | 8/2000 |

* cited by examiner

*Primary Examiner*—Peter M. Poon
*Assistant Examiner*—John Richardson

(57) ABSTRACT

An optical sight for a photocamera viewfinder or for an aiming device of a firearm comprises a combination of a light emitting diode (LED) with a plurality of reticle patterns applied onto the surface of the LED and selectively illuminated by connecting various portions of the reticle patterns to the source of electric power supply. The switching from one reticle pattern to another is carried out electrically without the use of moving parts of the reticles or reticle images. This ensures high accuracy in positioning of reticle elements with regard to each other, e.g., with regard to the front sight center of the partially transparent mirror, and hence, with regard to the ballistic trajectory of the bullet.

16 Claims, 4 Drawing Sheets

OPTICAL SIGHT WITH SWITCHABLE RETICLE

FIELD OF THE INVENTION

The present invention relates to optical sights, in particular to an optical gun sight with reticle patterns switchable for adaptation to various shooting conditions. More specifically, the invention relates to an optical sight, such as, e.g., a gunsight or a camera viewfinder, in which reticle patterns are switched electronically without mechanical movements.

BACKGROUND OF THE INVENTION

Optical sights are used in viewfinders for aiming photocameras or in firearms for accurate aiming of rifles, pistols, shotguns and the like. In firearms, these optical sights are typically mounted in an elongated tubular barrel or housing carrying conventional ocular and objective lens systems. An erector-lens system is provided between the ocular and objective systems to provide an erect target image for viewing by the shooter. Windage and elevation adjustments permit the sight to be compensated for targets at varying ranges.

For example, a conventional optical sight includes a reticle, typically of cross hair or post form, which is seen by the shooter in silhouette and superimposed over the target image. The position of the firearm is adjusted until the reticle is positioned on a target-image aiming point. The primary advantage of an optical sight is that the target image and reticle are in the same focal plane, eliminating any need for the shooter to shift eye focus between sight and target as must be done with conventional open sights on a rifle. The optical sight may provide fixed or variable magnification of the target image, but such magnification is not an essential feature and is subsidiary to the primary goal of providing a target image and aiming reticle in a single focal plane.

Conventional reticles are highly satisfactory during conditions of full daylight, but most hunting for game animals is done under restricted lighting conditions before sunrise or just before dark. This is because most game animals are nocturnal feeders, and their search for food is made in darkness or in the relatively short periods just before or after full darkness. A conventional optical sight is difficult to use in these conditions of subdued lighting because the reticle is seen in silhouette against a low-contrast dimly lit image of the target and target background. It is not uncommon for a hunter to lose sight of the reticle entirely while attempting to aim at a game animal standing or moving against a dark background of brush or trees. In such conditions, the firearm cannot be accurately sighted, and the animal will probably escape.

The "fading reticle" problem is solved by illuminating the reticle itself (e.g., electrically heated incandescent reticles have been proposed), or preferably by providing a luminous dot or other mark at the aiming point of the sight. Details of the latter solution are shown in U.S. Pat. No. 3,672,782 issued in 1972 to A. Akin. This patent shows a an optical sight with a battery-operated internal lamp, which projects a luminous reticle pattern (dot, cross hair, circle, etc.) on the sight field of view and centered on the sight aiming point. The optical sight of this patent is provided with multiple reticles, which can be selectively switched to a working position in compliance with the shooting conditions. This is achieved with the use of a flexible strip of a plastic material wound on extends between a pairs of shafts. The strip is generally opaque but defines specific transparent zones forming a plurality of reticles. Rotation of the shafts moves strips in certain fashion within a chamber in the mounting leg, and rotation is continued until a selected reticle is positioned for projection onto an ocular focal plane of the sight. Positions of the reticles are fixed with the use of spring-loaded knobs.

A disadvantage of the device of U.S. Pat. No. 3,672,782 consists in that the sight contains moveable parts and that the strip moves back and forth. Such a system, normally, has significant plays, which impair positioning of the reticles in the focal plane, and thus impairs accuracy of shooting.

U.S. Pat. No. 4,554,744 issued in 1985 to C. Huckenbeck is directed to an improved illuminated-reticle optical sight having a very compact battery-housing and actuating-switch assembly, which enhances the styling of the instrument, and is simple and convenient for the shooter to use. Though the optical sight of this device does not have moveable parts, it also does not have selectivity of reticles.

U.S. Pat. No. 4,618,221 issued in 1986 to R. Thomas describes an adjustable telescopic sight having objective lenses, intermediate lenses, and an eyepiece. The sight is provided with an adjustable reticle device, which is disposed in the second focal plane intermediate, the eyepiece and the intermediate lenses. The adjustable reticle device is provided with a fixed centerline reticle and two identical moveable reticles located on opposite sides of the centerline reticle. The moveable reticles are each supported by a carrier, which is moveable in two orthogonal directions by means of two threaded stems carried by the body of the adjustable reticle device. The stems are each provided with knurled knobs, each of which has two arrows thereon disposed at right angles to each other on the side of the knob facing the shooter so that the shooter can readily determine the direction of movement of bullet impact upon rotation of a knob in any specific direction.

Although this device is capable of adjusting position of a reticle with relatively high accuracy due to micrometric movements and of selecting reticles of a few types, the choice of reticles is very limited and the adjustment is carried out due to movement of reticle parts.

International Patent Publication WO 00/50836 of Aug. 31, 2000 issued to K. Gunnarsson, et al. describes an optical sight with a reticle produced by projecting a reticle image from a transparent media onto a concave semitransparent mirror. The source of light is a light emitting diode (LED), which is located on a sidewall within a tubular casing of the optical sight. The LED, the transparent media with the reticle image, the semitransparent concave mirror, and the eye of the viewer form an optical system, in which the reticle image is reproduced on the eye retina, while the image of the reticle is located on the optical axis of the optical system and is seen by the eye as if it is located in the infinity or in a very remote zone. During shooting, the reticle is aligned with the image of the target, which is also seen by the viewer's eye. Such a system ensures accurate aiming and is free of moveable parts. Furthermore, the sight of the type disclosed in WO 00/50836 is a sight of a collimating type, which does not have an optical eyepiece on the viewer's side and therefore has a not limited eye relief. An eye relief is a distance from the viewer eye to the sight. However, this system has only one reticle and cannot be adjusted for different shooting conditions.

In order to solve the above problem, American Technologies Network Corporation, South San Francisco, Calif., has developed an optical sight of the type described in WO 00/50836, but with a turret head that contains a plurality of reticle images, which can be selectively switched to a position aligned with the optical axis by rotating the turret head. Such a system makes it possible to select reticles in compliance with the shooting conditions, shooter's vision conditions, shooter's hunting habits, type of the target, etc. Nevertheless, the turret-type reticle switching mechanism has moveable parts and therefore has inevitable plays in the rotary mechanism. Since the image of the reticle is projected to the infinity and is seen as a virtual image, even slightest deviations of the reticle image projection from the optical axis will impair accuracy of shooting.

Thus, all known switchable optical sights of the types described above cannot ensure stability in positioning of the reticle with respect to the center of the partially transparent mirror or pellicle, and hence, with respect to the ballistic trajectory of the bullet. This is because the plays existing in the switching mechanisms with the moveable reticles or reticle elements cannot provide aforementioned positioning accuracy.

OBJECTS OF THE INVENTION

It is an object of the invention is to provide an optical sight for use in viewfinders of photocameras, or in aiming devices of fire arms, which is simple in construction, inexpensive to manufacture, has no moving parts, and ensures selection of reticle types and images in a wide range in compliance with the shooting conditions.

SUMMARY OF THE INVENTION

An optical sight for a photocamera viewfinder or for an aiming device of a firearm comprises a combination of a light emitting diode (LED) with a plurality of reticle patterns applied onto the surface of the LED and selectively illuminated by connecting various portions of the reticle patterns to the source of electric power supply. The switching from one reticle pattern to another is carried out electrically without the use of moving parts of the reticles or reticle images. This ensures high accuracy in positioning of reticle elements with regard to each other, e.g., with regard to the front sight center of the partially transparent mirror, and hence, with regard to the ballistic trajectory of the bullet.

DETAILED DESCRIPTION OF THE INVENTION

Figure 1:
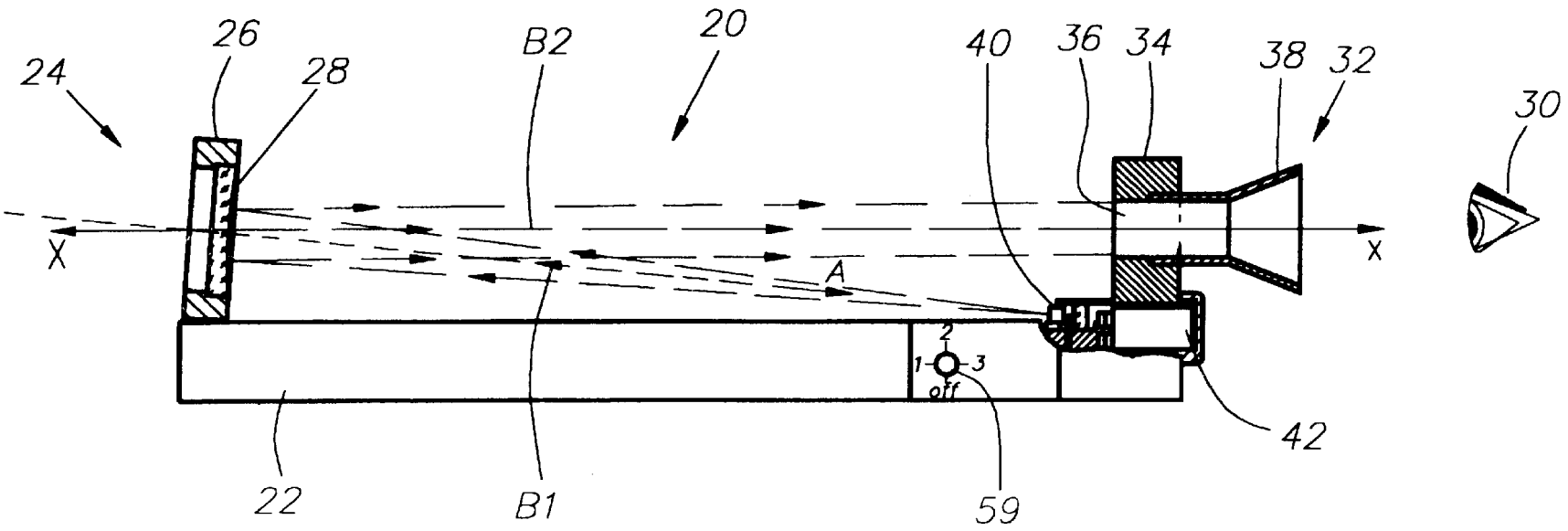
FIG. 1 is a general schematic side view of the optical sight of the invention.

A general schematic side view of the optical sight of the invention is shown in FIG. 1. In the embodiment shown in FIG. 1, the optical sight 20 of the invention is implemented as a firearm sight or a firearm-aiming device. The device consists of a mounting plate 22, which is attachable to a firearm, e.g., with the use of a dovetail connection and locking screw (not shown). The mounting plate 22 has on its distal end 24 (which is the end nearest to the target) a vertically arranged partially transparent pellicle or mirror 26 with a red-light reflection coating 28 applied onto a slightly concave surface of the mirror 26 formed on the side of the mirror facing a viewer. In FIG. 1 the viewer is represented by an image of a human eye 30. The aforementioned coating 28 may have properties of a narrow-band mirror which passes all wavelengths except for the wavelength of 650±10 nm, which is seen as a red light.

On the proximal side 32, the mounting plate 22 supports a vertical bracket 34 with an opening 36 through which the viewer's eye 30 can see the target (not shown) through the partially reflecting mirror 26. An eyepiece 38 can be attached to the rear side of the bracket 34 for convenience of the viewer.

A light-emitting diode (LED) 40 is installed on the mounting plate 22 in the proximal part of the optical sight 20 and in a position offset from the optical axis X—X. The LED 40 is spaced from the coating 28 at a distance equal to half the radius of the curvature on the concave surface of the mirror so that the light beam B1 emitted from the LED 40 is reflected from the mirror coating 28 as a collimated beam B2. It is understood that the mirror coating 28 is perpendicular to beam B2. If beam B2 carries an image (reticle), this image will be localized on the retina of the viewer'ss eye and will be seen as if it is located in the infinity. When the target appears in the vision field of the viewer, the latter moves the reticle image, and hence the rifle, to which the sight 20 is attached, and aims the weapon to the target by superposing the reticle image onto the target image. Reference numeral 42 designates a power source, e.g., a lithium battery, which supplies electric current to the LED 40. To this point of the explanation, the optical sight is generally the same as the conventional optical sight with a reticle illuminated by a LED.

A distinguishing feature of the optical sight of the invention is a set of reticle elements and a method of generation of selected reticles, which can be aligned with the optical axis of the sight by using electric means, i.e., without moving any parts of reticles or reticle combinations.

Figure 2A:
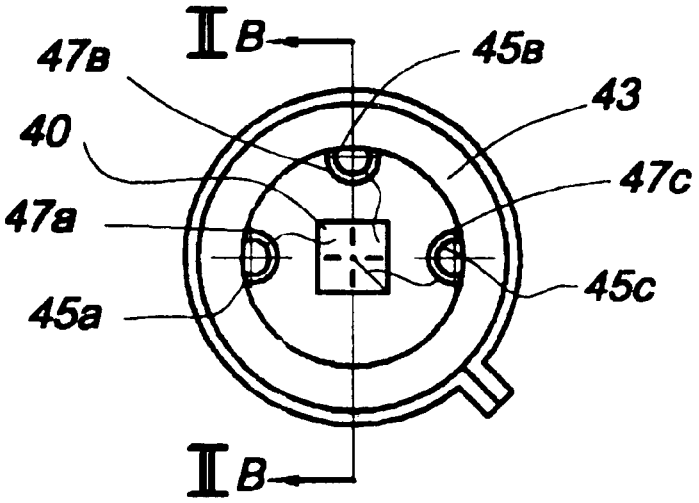
FIG. 2A is a view of the LED in the direction of arrow A of FIG. 1.
Figure 2B:
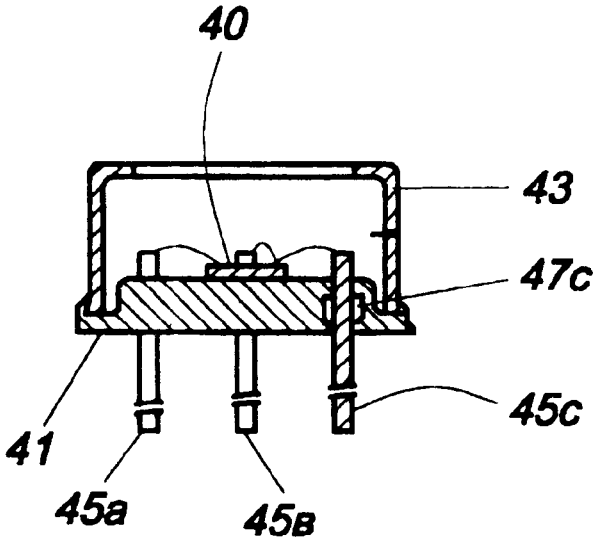
FIG. 2B is a sectional view along the line IIB—IIB of FIG. 2A.

More specifically, as shown in FIG. 2A, which is a view of the LED 40 in the direction of arrow A of FIG. 1, the reticle is formed on the outer surface of the LED 40. FIG. 2B is a sectional view along the line IIB—IIB of FIG. 2A. The arrangement of the LED shown in FIG. 2B is known as TO-CAN. This term is used for opto-electronic components mounted in closed containers with a transparent window. The LED unit consists of a metallic LED holder 41 which supports the LED 40. The LED 40 is covered with a cup-shaped cover 43. The upper electrodes (which will be described later) of the LED 40 are connected to output terminals 45*a*, 45*b*, 45*c* which protrude outside the LED assembly through insulators 47*a*, 47*b*, 47*c* (FIG. 2A).

Figure 3:
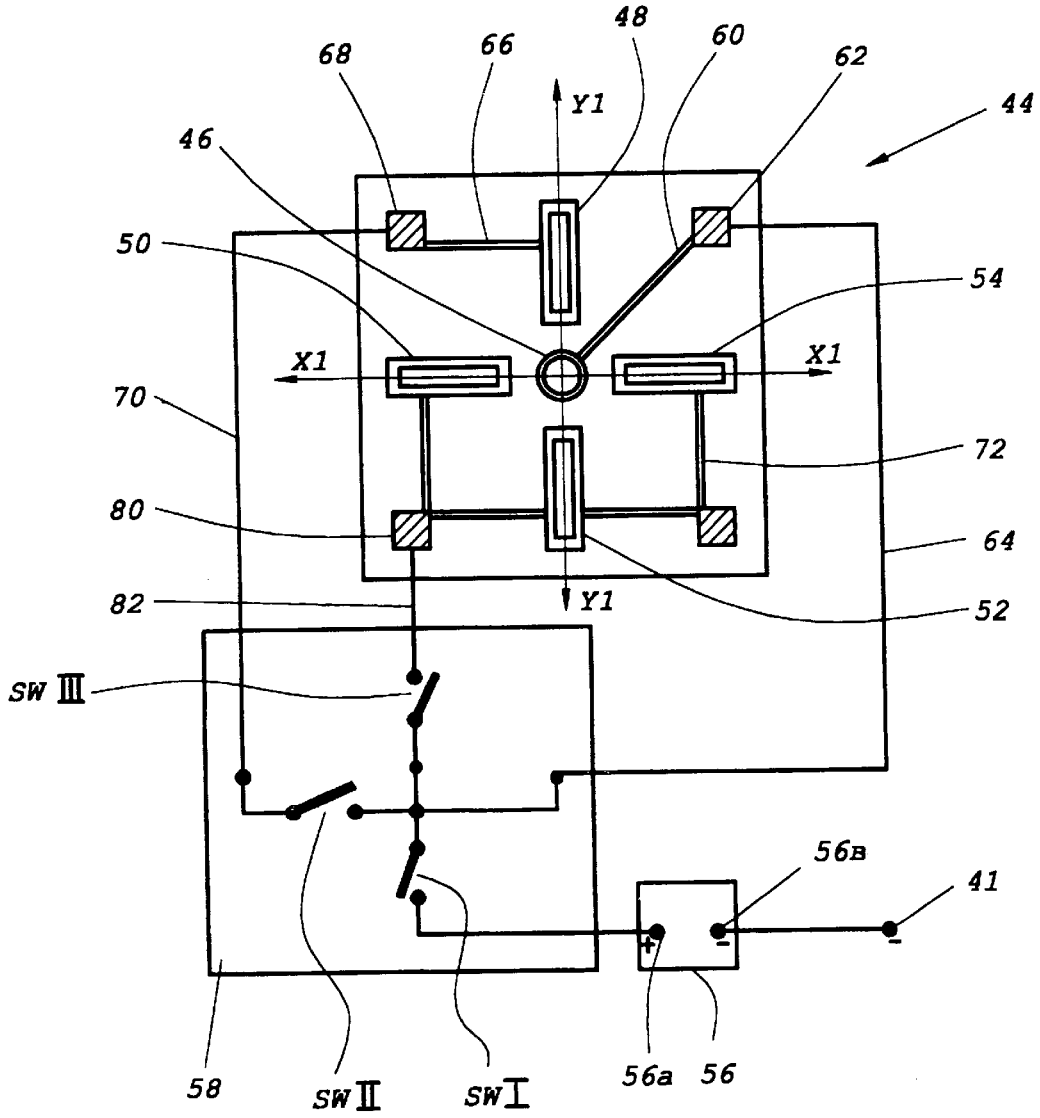
FIG. 3 is a more detailed image of the pattern of reticle elements with an electrical circuit.

A more detailed image of the reticle and of the pattern of reticle elements is shown in FIG. 3. As can be seen from FIG. 3, the reticle consists of a central light spot 46 and a plurality of luminous bars, in this case of four luminous bars 48, 50, 52, and 54. These luminous bars constitute the aforementioned upper electrodes of the LED 40. The bars 50 and 54 are arranged symmetrically on both sides of the light spot 46 on a horizontal line X1—X1, while the bars 48 and 52 are arranged symmetrically on both sides of the light spot 46 on a vertical line Y1—Y1. Thus, the light spot 46 is located in the center of a cross formed by the luminous bars 48, 50, 52, and 54.

The luminous bars 48, 50, 52, and 54 can be formed on the surface of the LED 40, e.g., by a method of photolithography from a conductive material, e.g., from aluminum or chromium. In one model of the sight of the invention tested by the applicant, the LED 40 was a custom-made homo-transition type LED based on epitaxial structures of gallium arsenide phosphide alloy/gallium arsenide alloy (GaAsP/GaAs). The LED 40 was made with a large surface (with a diameter of about 2 to 3 mm) on which the radiation elements are formed so that it would be possible to perform the aforementioned photolithography. Each element of the reticle, i.e., a bar or a light point, is a closed-loop contour in the form of an elongated rectangle or a circle, so that the perimeter of the closed-loop contour determines the shape of the reticle element, i.e., rectangles, lines, circles, parts of the circle, dots, etc. As shown in FIG. 3, the upper electrodes or luminous bars 48, 50, 52, and 54 and the light spot 46 are connected to a positive terminal 56*a* of a source of power supply 56, e.g., a lithium battery via an electric circuit with an electric switch 58. A negative terminal 56*b* of the power source 56 is connected to the metallic LED holder 41 (FIG. 2B). Thus, a negative potential of the power source 56 is applied to the metallic holder 41, which is in contact with the bottom of the LED 40, while a positive potential is applied to the selected upper electrode which is represented by the selected elements of the reticle. The switch 58 can be a rotary type switch, a button-type switch, or an electronic switch. In the general view of the sight shown in FIG. 1, the control element of the switch 58 is shown as a rotary knob 59 which can be switched between four positions, i.e., a position "1", a position "2", a position "3", and a position "OFF". As shown in FIG. 3, the switch 58 has three switchable contacts SW1, SW2, and SW3, which can be closed or opened in various combinations determined by the aforementioned positions of the knob 59. The light point 46 is connected to the switch 58 via a conductor 60, a contact point 62 on the surface of the LED 40, and a conductor 64. The luminous bar 48 is connected to the switch 58 via a conductor 66, a contact 68 on the surface of the LED 40, and a conductor 70. The luminous bars 50, 52, and 54, which are connected parallel to each other via conductors 72, 74, and 76, are connected to the switch 58 via a conductor 78, a contact 80 on the surface of the LED 40, and a conductor 82.

At the maximum of its radiation, this LED generated red light of 65±10 nm. With the d.c. current of 20 $\mu$A, the LED 40 produced light with the brightness of not less than 150 $\mu$cd.

Operation temperature ranged from minus 60° C. to plus 70° C.

Figure 4:
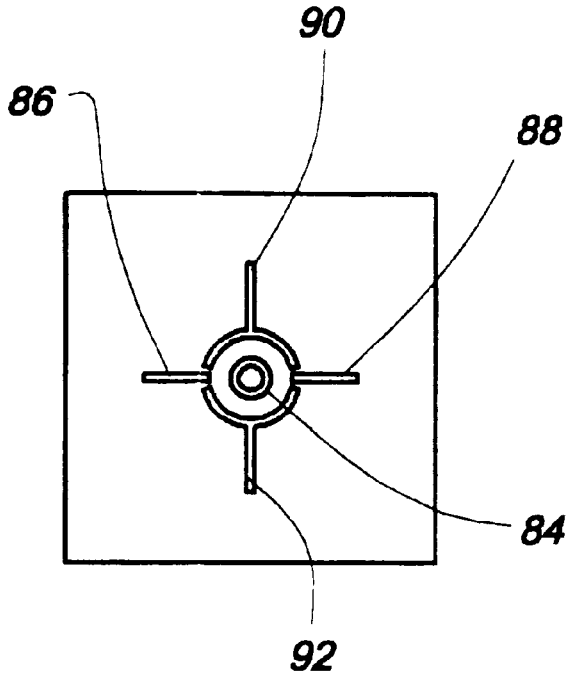
FIGS. 4 and 5 illustrate examples of other patterns of reticle elements.
Figure 5:
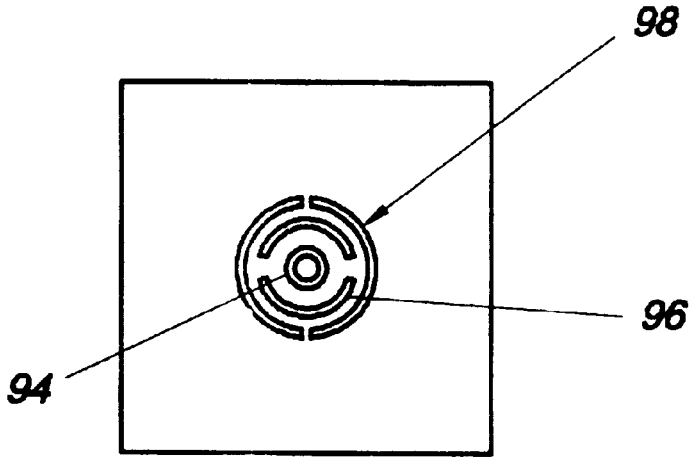

The reticle pattern shown in FIG. 3 makes it possible to select the following reticle shapes: a light point 46, a light point 46 in the center of a cross formed by the luminous bars 48, 50, 52, and 54, a combination of the light point 46 with the luminous bars 50, 52, and 54. It is understood that this simplified pattern was shown only as an example that illustrates the principle of the invention. It is understood that many other patterns and combinations of luminous elements are possible. Examples of other patterns are shown in FIGS. 4 and 5. The pattern of FIG. 4 consists of a central light spot 84, two horizontal luminous bars 86 and 88 arranged symmetrically on both sides of the light spot 84, and two arched elements 90 and 92 with outward radial projections. The elements 90 and 92 are also arranged symmetrically in a vertical direction with respect to the light point 84. In the example of FIG. 5, the reticle is formed by a central light point 94 with two concentric luminous elements 96 and 98, each consisting of arched portions separately connected to the power source via respective conductors (not shown). In this embodiment, the light point 94 can be combined with either of the circular reticles 96 and 98, or can be combined with both of the at the same time.

OPERATION OF THE OPTICAL SIGHT OF THE INVENTION

In operation, when a hunter needs to select a specific reticle combination which to the most extent satisfies his/her needs with regard to the shooting conditions, shooting habits, type of a target, etc., he/she selects one position of the switch 58. For example, when only a light spot 46 is needed in the reticle of FIG. 3, the switch 58 is installed to a position, in which the light point 46 is electrically connected to the switch 58 via a conductor 60, a contact point 62 on the surface of the LED 40, and a conductor 64. In this selection, which corresponds, e.g., to the position "1" of the knob 59, the switchable contact SW1 is closed and the switchable contacts SW2 and SW3 are open. When it is necessary to illuminate a light point 46 and the cross formed by the luminous bars 48, 50, 52, and 54, all three switchable contacts SW1, SW2, and SW3 are closed (position "2" of the knob 59), and when it is necessary to select a combination of the light point 46 with the luminous bars 50, 52, and 54, the switchable contacts SW1 and SW3 are closed, while the switchable contact SW2 is opened (position "3" of the knob 59). Position "OFF" of the knob 59 corresponds to the condition when all elements of the reticle are disconnected from the source of power supply 56. It is understood that the switchable contacts are interlocked in such a manner that switching of contacts from one position to another automatically selects right position for the switchable contacts of the selected pattern and eliminates combination of the switchable contacts corresponding to the previous pattern.

Once the reticle pattern is selected, the shooter tries to find the target in the vision field of the optical sight 20 while constantly observing the reticle 44 as seen as if it is located in the infinity or in a very remote zone. The reticle 44 is aligned with the image of the target, which is also seen by the shooter's eye.

Thus, it has been shown that the invention provides an optical sight for use in viewfinders of photocameras, or in aiming devices of fire arms, which is simple in construction, inexpensive to manufacture, has no moving reticles or reticle elements, and ensures selection of reticle types and images in a wide range in compliance with the shooting conditions. Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the optical sight of the invention can be used in riflescopes, camcoders, telescopes, telescopic tubes, binoculars, surveying tools, navigation instruments, microscopes, optical micropositioning devices, etc. An unlimited variety of reticle patterns are possible, such as squares, triangles, ovals, hair lines, semi circles, or their combinations. The sight itself can be an open type or enclosed in a tubular housing. The brightness of the reticle image can be adjusted by changing the current supplied to the LED. The current adjustment control can be connected via a feedback line to an automatic exposure meter for automatically adjusting the reticle brightness in compliance with the environmental lighting conditions. The LED may emit light other than red.

What I claim is:

1. A collimating optical sight for an aiming device comprising:

partially transparent means rigidly attached to said aiming device;

a light-emitting source with at least two luminous elements formed on the surface of said light emitting source, said light-emitting source being rigidly attached to said aiming device and emitting a beam of light onto said partially transparent means so that a portion of said light is reflected from said partially transparent means;

a reticle formed by said at least two luminous elements;

an aperture means which are attached to said aiming device and has an opening which limits the field of vision of a viewer and through which images of said at least two luminous elements are seen by said viewer on said partially transparent means;

a source of current power supply electrically connected to said at least two luminous elements for their illumination; and electronic switching means without moveable parts and with contacts electronically switchable between at least two positions in which said luminous elements are selectively illuminated.

2. The collimating optical sight of claim 1, wherein said light-emitting source is a light emitting diode with at least two luminous elements.

3. The collimating optical sight of claim 2, wherein said light emitting diode emits light with wavelength of 650±10 nm.

4. The collimating optical sight of claim 1, wherein said partially transparent means is selected from the group consisting of a partially transparent mirror and a pellicle, said mirror and said pellicle passing lights of all wavelength except for the wavelength of the light emitted by said light emitting means.

5. The collimating optical sight of claim 4, wherein said a light-emitting source is a light emitting diode with at least two luminous elements.

6. The collimating optical sight of claim 5, wherein said light emitting diode with at least two luminous elements emits light with wavelength of 650±10 nm.

7. The collimating optical sight of claim 1, wherein said at least two luminous elements are selected from the group consisting of a point, a line, a part of a circle, and a closed-loop contour in the form of an elongated rectangle and a circle.

8. The collimating optical sight of claim 7, wherein said partially transparent means is selected from the group consisting of a partially transparent mirror and a pellicle, said mirror and said pellicle passing lights of all wavelength except for the wavelength of the light emitted by said light emitting means.

9. The collimating optical sight of claim 8, wherein said a light-emitting source with at least two luminous elements is a light emitting diode.

10. The collimating optical sight of claim 9, wherein said light emitting diode with at least two luminous elements emits light with wavelength of 650±10 nm.

11. A collimating optical sight for aiming a firearm at a target by aligning a viewer eye with said target, said collimating optical sight comprising:

a mounting plate attachable to said firearm, said mounting plate having a distal end, which is closer to said target, and a proximal end, which is closer to said viewer eye;

a partially transparent mirror rigidly attached to said distal end of said mounting plate;

a light-emitting diode rigidly attached to said proximal end of said mounting plate and emitting a light beam towards said partially transparent mirror, said partially transparent mirror being perpendicular to said light beam;

a reticle comprising a plurality of luminous elements formed on the surface of said light-emitting diode;

a vertical bracket with an aperture which is rigidly attached to said proximal end of said mounting plate, said aperture limiting the field of vision of said viewer and being used for viewing images of said plurality of luminous elements on said partially transparent mirror;

a source of direct current power supply electrically and selectively connected to each of said luminous elements of said plurality for their selective illumination; and electronic switching means without mechanically moving parts with contacts electronically switchable between plurality of positions in which said luminous elements are selectively illuminated.

12. The collimating optical sight of claim 11, wherein said partially transparent mirror has a concave surface facing said light-emitting diode.

13. The collimating optical sight of claim 12, wherein said light emitting diode emits light with wavelength of 650±10 nm.

14. The optical sight of claim 11, wherein said plurality of luminous elements are selected from the group consisting of a point, a line, a part of a circle, and a closed-loop contour in the form of an elongated rectangle and a circle.

15. A method of selecting a reticle in an optical sight comprising a partially transparent mirror, a light emitting diode emitting a light beam towards said partially transparent mirror, and a plurality of luminous reticle elements formed on the surface of said light emitting diode, said method comprising the steps of:

providing a source of a current supply selectively connectable to each of said reticle elements of said plurality;

selecting a selected reticle by selecting at least one of said reticle elements of said plurality; and forming said selected reticle by selectively illuminating said at least one reticle element.

16. The method of claim 15, wherein said plurality of said reticle elements are selected from the group consisting of a point, a line, a part of a circle, and a closed-loop contour in the form of an elongated rectangle and a circle.

* * * * *